US005099865A

United States Patent [19]

Flannery et al.

[11] Patent Number: 5,099,865

[45] Date of Patent: Mar. 31, 1992

[54] HAIR WASHING AID

[75] Inventors: Rita Flannery; Mary B. Henry, both of Tubbercurry, Ireland

[73] Assignee: Healthcare Design Limited, Springmount, Tubbercurry, Ireland

[21] Appl. No.: 620,857

[22] Filed: Dec. 3, 1990

[30] Foreign Application Priority Data

Dec. 1, 1989 [IE] Ireland ..... 2179/89

[51] Int. Cl.[5] ..... A45D 7/02

[52] U.S. Cl. ..... 132/212; 2/174; 4/516; 4/521

[58] Field of Search ..... 132/212, 270, 319, 333; 4/515, 516, 517, 520, 521; 2/174, 202, 204, 205

[56] References Cited

U.S. PATENT DOCUMENTS

| | | | |
|---|---|---|---|
| 2,211,184 | 8/1940 | Varell | 2/174 |
| 2,434,279 | 1/1948 | McDonough et al. | 132/205 |
| 2,547,810 | 4/1951 | Burgess | 4/521 |
| 2,600,557 | 6/1952 | Marriott | 132/212 |
| 2,684,072 | 7/1954 | Lewis | 132/212 |
| 3,040,336 | 6/1962 | Plank | 4/521 |
| 3,044,473 | 7/1962 | Cover . | |
| 3,268,913 | 8/1966 | Gettinger | 2/174 |
| 3,416,517 | 12/1968 | Adams et al. . | |
| 3,456,655 | 7/1969 | Hale | 132/212 |
| 3,752,399 | 8/1973 | Neale et al. . | |
| 3,863,651 | 2/1975 | Vaiano . | |
| 3,962,728 | 6/1976 | Pavlinik | 2/174 |
| 3,996,946 | 12/1976 | Craig . | |
| 4,074,369 | 2/1978 | Harmon . | |
| 4,173,042 | 11/1979 | Krzewinski-Morris | 2/174 |
| 4,361,158 | 11/1982 | Baker | 132/212 |
| 4,605,017 | 8/1986 | Thompson et al. | 132/333 |

FOREIGN PATENT DOCUMENTS

| | | | |
|---|---|---|---|
| 0034130A | 1/1981 | European Pat. Off. . | |
| 2593042 | 7/1987 | France | 132/212 |
| 78542 | 5/1951 | Norway | 132/212 |

*Primary Examiner*—John J. Wilson
*Assistant Examiner*—Frank A. LaViola
*Attorney, Agent, or Firm*—Finnegan, Henderson, Farabow, Garrett and Dunner

[57] ABSTRACT

A hair washing aid 1 comprises a disposable flexible hood 2 having an opening 4 for fitting around the head 5 of an invalid and an inlet 6 at the top of the hood 2 for water and shampoo. The inlet 6 is sized to accommodate an attendant's hands for washing the hair, in use. A double sided hypo-allergenic tape 10 is used to attach the hood 2 in position and to form a fluid barrier to prevent fluid escaping from the hood 2, in use. An overlapping flap portion 20 of the hood 2 allows the hood to accommodate a range of head sizes. An integrally formed extension 30 of the hood defines a pocket for collection of water and shampoo run-off.

11 Claims, 4 Drawing Sheets

HAIR WASHING AID

BACKGROUND OF THE INVENTION

The invention relates to a hair washing aid, and in particular to a hair washing aid for use in washing the hair of invalids.

DESCRIPTION OF PRIOR ART

Various rigid helmet-type shampooing units are known, for example from EP 0,034,130A, U.S. Pat. No. 3,863,651, U.S. Pat. No. 3,752,399, U.S. Pat. No. 3,416,517 and U.S. Pat. No. 3,044,473. Such units are generally difficult and/or impractical for use in hospital or home settings and are not readily transportable.

U.S. Pat. No. 4,074,369 describes a portable shampooing unit having an opening for engaging the head of a patient. The hood is provided with a band of polyurethane foam material and includes an outer wall and an inner wall having openings through which a shampooing liquid is passed. The shampooing action is said to be provided by pumping water through the inlet at sufficient pressure to wash the hair.

U.S. Pat. No. 3,996,946 describes a rinse cape or bib having a cut-out and elastic drawstrings which are secured around the head of the patient. The cape is shaped to expose as much as possible of the head area for washing.

These prior art hair washing aids suffer from the disadvantage of requiring high pressure liquid jets to achieve a shampooing action and/or the hair washing aids do not sufficiently seal and retain the hood in position, in use.

OBJECTS OF THE INVENTION

This invention is directed towards providing an improved hair washing aid to overcome those difficulties.

SUMMARY OF THE INVENTION

According to the invention there is provided a hair washing aid comprising:

- a flexible hood of water impermeable material, the hood having:
  - a head engaging flange defining an opening for fitting around the head;
  - sealing means comprising a tape mounted on the head engaging flange for sealingly engaging the head adjacent to the flange to form a fluid barrier; and
  - an entry flange defining an inlet adjacent the top of the hood for water and shampoo, the inlet being sized to accommodate an attendant's hands for washing the hair.

In a particularly preferred embodiment of the invention the tape is a pressure sensitive double sided tape, one side of the tape being attached to the inner surface of the head engaging flange and the other side of the adhesive tape being covered with a liner which is peeled off, in use, to expose the adhesive for sealing engagement to the head.

Preferably, the tape and adhesive are of hypo-allergenic material.

In a preferred embodiment of the invention the hood includes an overlapping flap portion to accommodate a range of head sizes.

Preferably, the free end of the overlapping flap portion is sealed to the hood by a double sided tape, in use.

In another embodiment of the invention the hood includes an extension defining a collecting pocket for water run-off from the hair, in use.

In a preferred embodiment of the invention the pocket is provided with a liquid drain tube for draining liquid from the pocket.

In a preferred embodiment of the invention the hood is formed from two sheets of flexible plastics material joined together along the edges thereof except at the head engaging flange and the entry flange.

Preferably, the hair washing aid includes a spray nozzle for delivering a fine spray of water through the inlet opening in the hood.

Preferably, the hair washing aid also includes a liquid supply container and a pump for delivery of liquid from the container to the nozzle.

DESCRIPTION OF THE DRAWINGS

The invention will be more clearly understood from the following description thereof, given by way of example only with reference to the accompanying drawings in which.

DETAILED DESCRIPTION OF PREFERRED EMBODIMENTS

Figures 1, 4, 5:
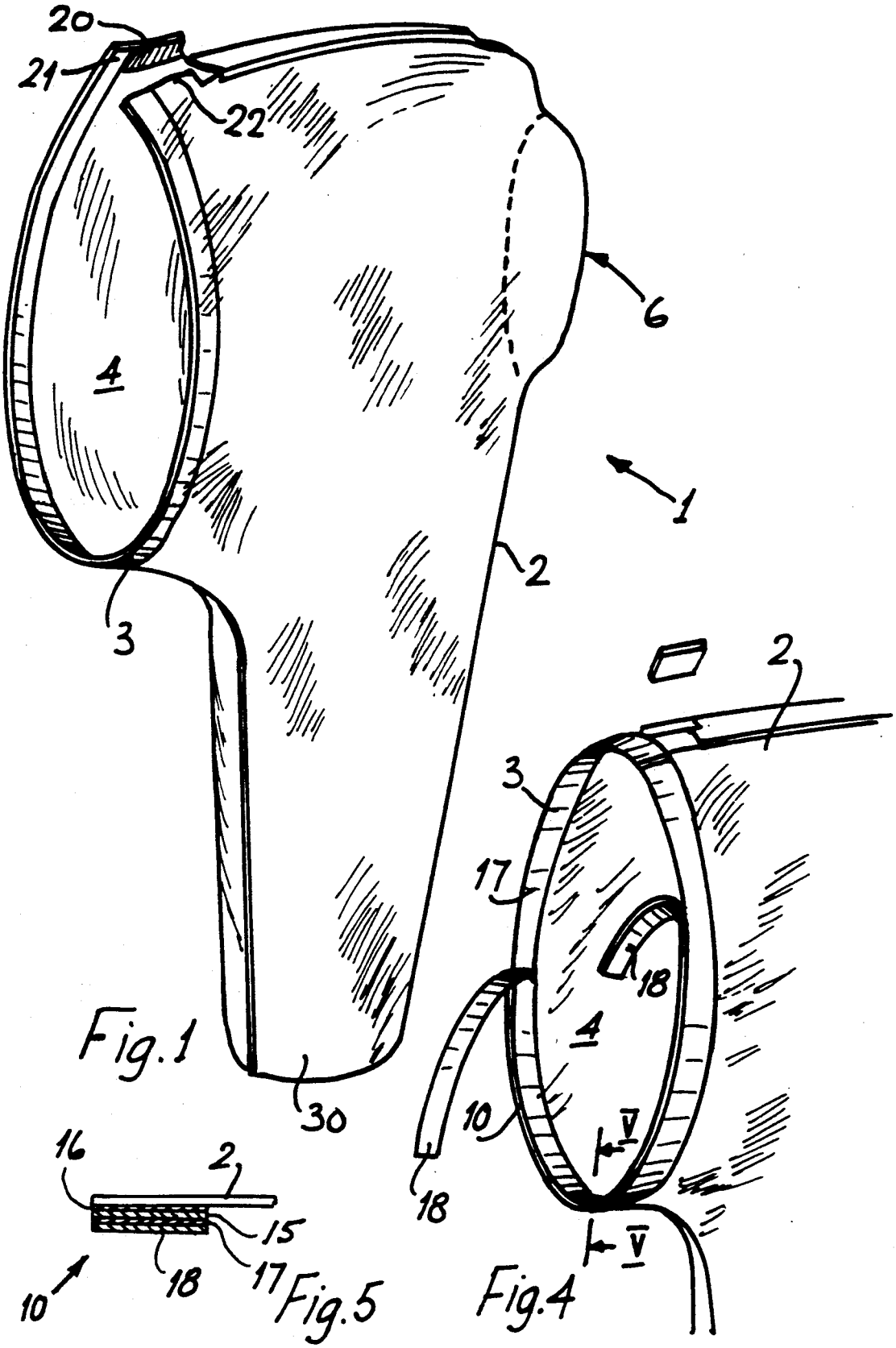
FIG. 1 is a perspective view of the hair washing aid according to the invention.
FIG. 4 is a perspective view of portion of the hair washing aid, being prepared for use.
FIG. 5 is a cross sectional view of a detail of the hair washing aid.
Figure 2:
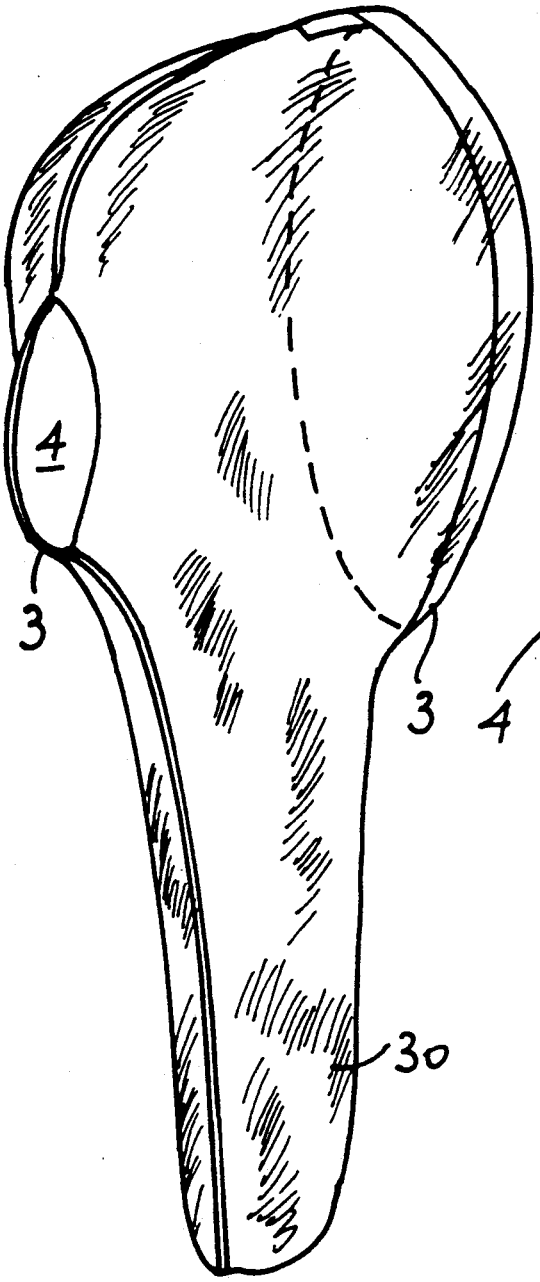
FIG. 2 is another perspective view of the hair washing aid.
Figure 3:
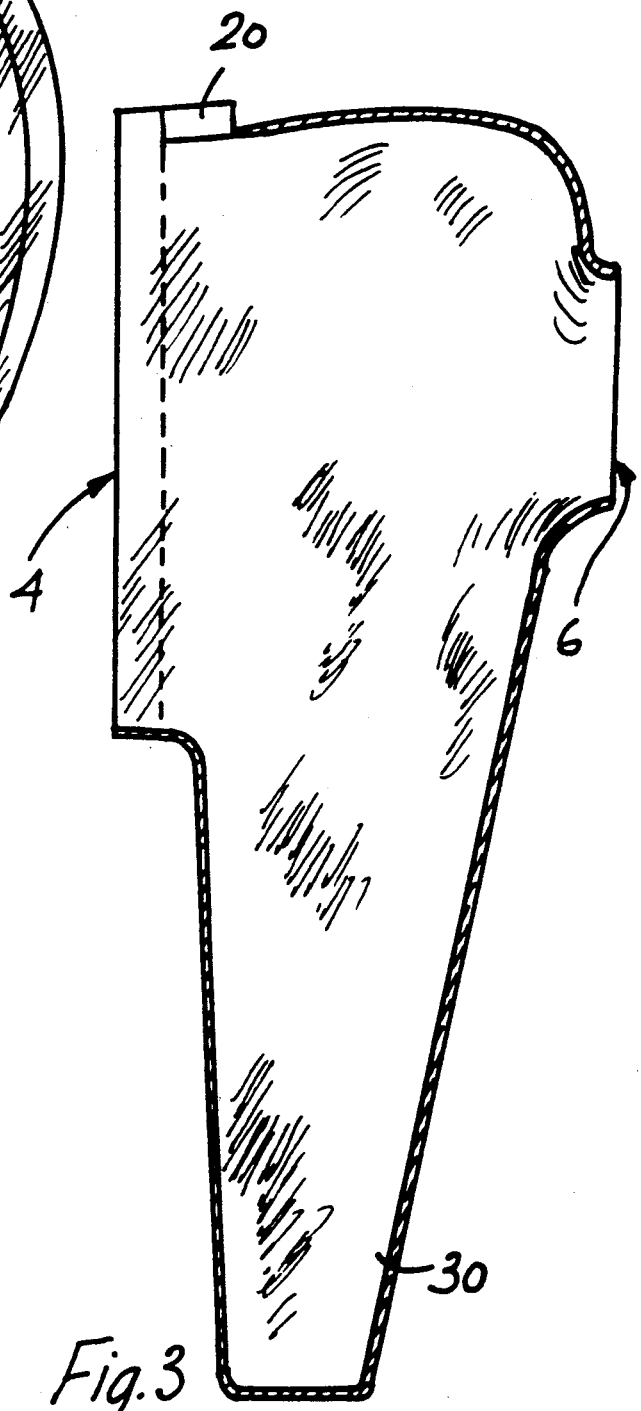
FIG. 3 is a side elevational view of the hair washing aid.

Referring to the drawings there is illustrated a hair washing aid according to the invention, indicated generally by the reference numeral 1. The hair washing aid 1 comprises a disposable flexible hood 2 which is preferably of water impermeable plastics material such as polyvinylchloride or polyethylene material. Typically the hood is formed from two sheets of flexible plastics material joined together along the edges thereof, for example by heat sealing. The hood 2 has a head engaging flange 3 defining an opening 4 for fitting around the head 5 of an invalid and an upper entry flange 7 defining an inlet 6 at the top of the hood 2 for water and shampoo, the inlet 6 being sized to accommodate an attendant's hands for washing the hair, in use.

Figure 6:
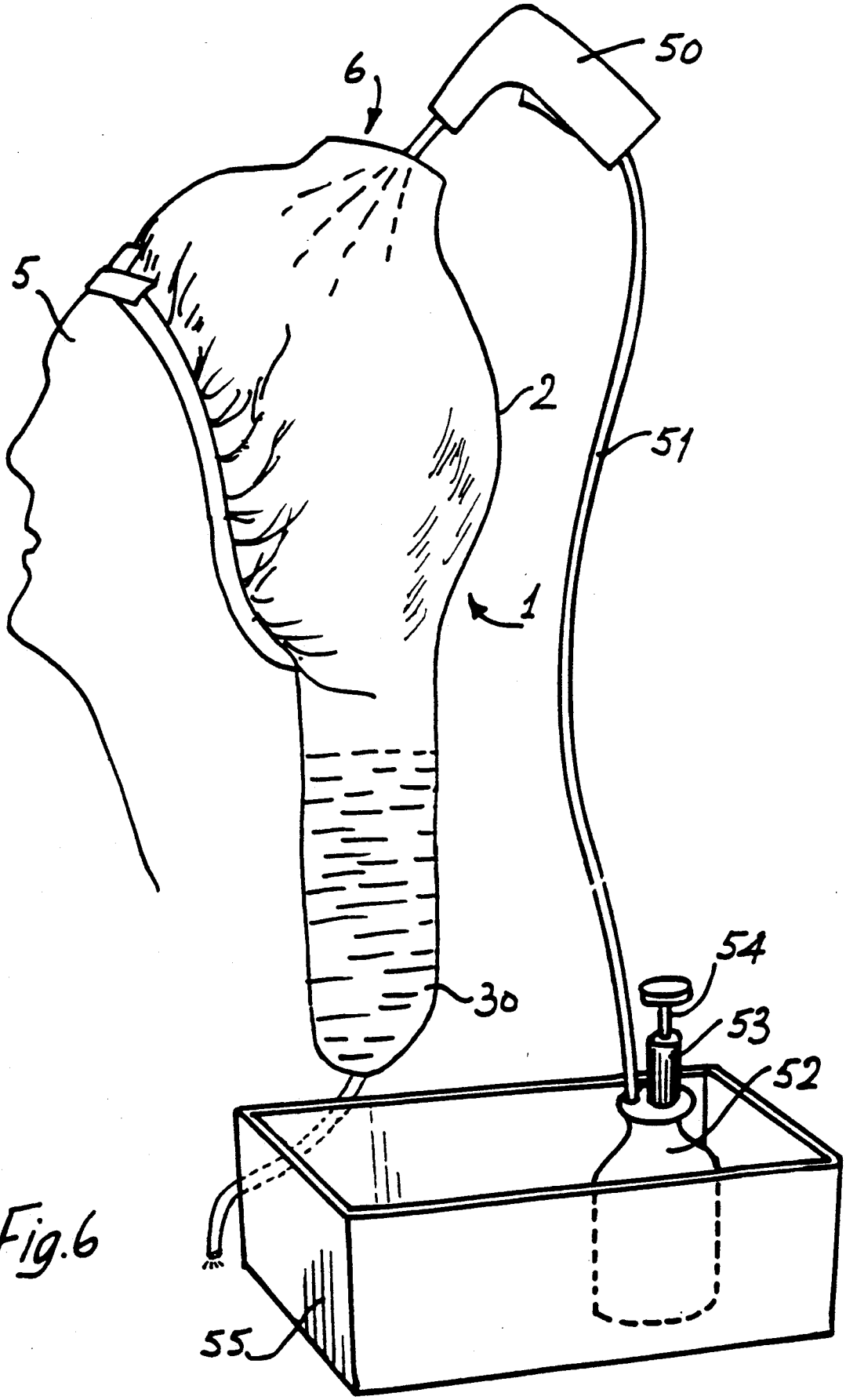
FIG. 6 is a perspective view of the hair washing aid, in use.
Figure 7:
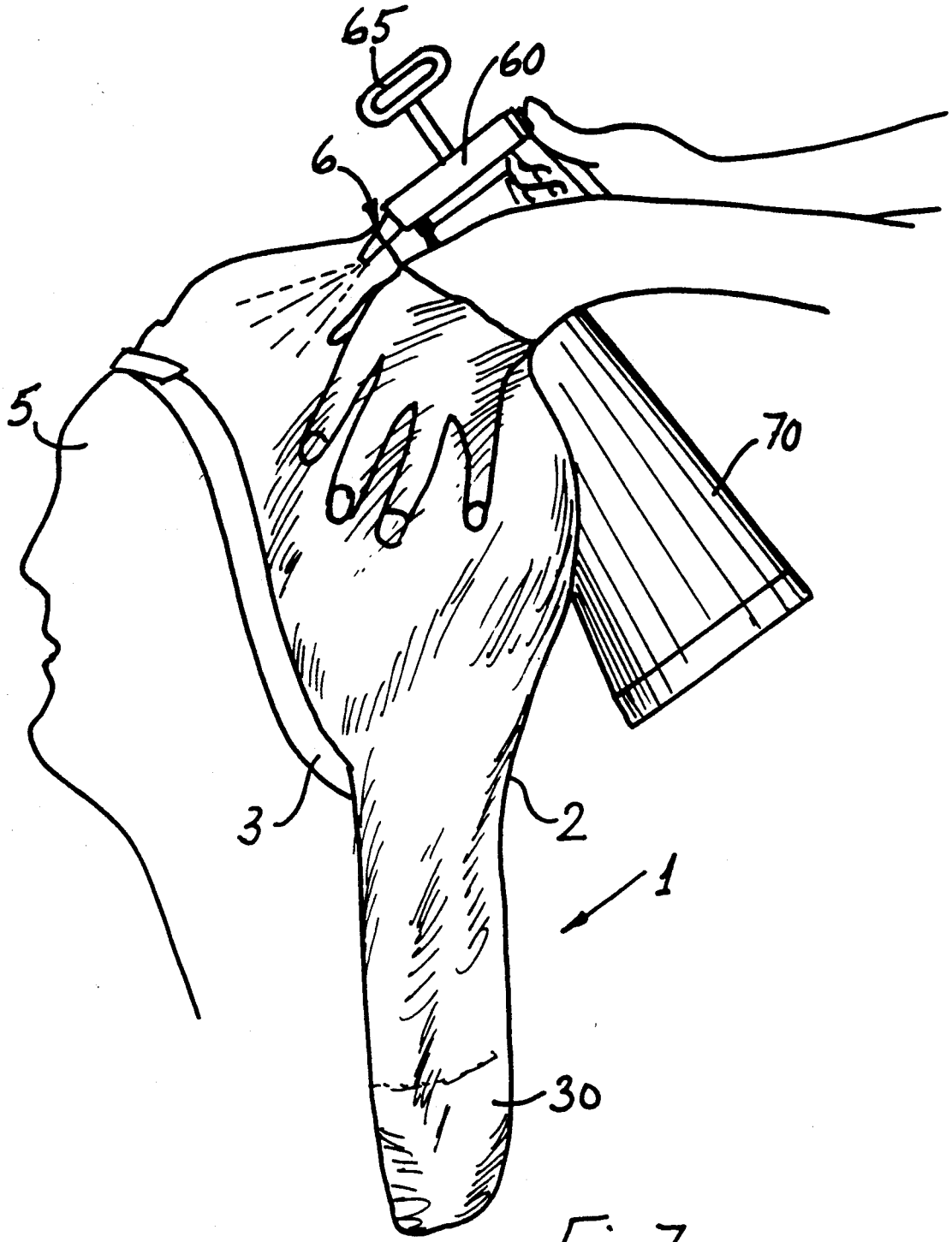
FIG. 7 is another perspective view of the hair washing aid, in use.

Sealing means in the form of a tape 10 is provided around the head engaging flange for sealingly engaging the head 5 adjacent to the flange 3 to form a fluid barrier substantially preventing fluid escaping from the hood 2, in use. The tape 10 is a pressure sensitive double-sided tape and is illustrated diagrammatically in FIG. 5. The tape 10 comprises a carrier 15, one side of which is provided with a layer of adhesive 16 for mounting to the inner side of the head engaging flange 3 and the other side of which is provided with a further layer 17 of adhesive covered with a liner 18 which is peeled off in use, as illustrated in FIG. 4, to expose the adhesive 17 for sealing engagement to the skin around the hairline as illustrated in FIGS. 6 and 7.

Although the tape will not be attached to the user's skin for lengthy periods it is preferable that the tape be of hypo-allergenic material to minimise irritation to the skin, in use. The carrier, liner and adhesive layers may be of any suitable material.

As will be apparent, particularly from FIG. 1, the hood 2 includes an overlapping flap portion 20 which overlaps with a flap portion 22 in use to accommodate a range of sizes of patients' heads. The tape 21 may be the same double-sided tape as the tape 10 for the head engaging flange 3.

It will also be noted that the hood 1 includes an integrally formed extension 30 forming a water collecting pocket for collection of water and shampoo run-off.

In the arrangement illustrated in FIG. 6 a gun-type water spray nozzle 50 is used to apply a spray of water onto the hair. The nozzle 50 is connected by a flexible hose 51 to a water supply bottle or tank 52 having a hand pump 53 with an operating plunger 54 for delivery of water from the bottle 52 to the applicator nozzle 50. The supply bottle 52 is housed in a case or kit bag 55 in which a supply of disposable hoods 2 are mounted for storage.

In the arrangement illustrated in FIG. 7 a gun-type water spray nozzle 60 is used to apply a spray of water onto the hair. The nozzle 60 is provided on a water supply bottle 70 which in this case includes a plunger 65.

In use, the liner 18 of the tapes 10 and 20 is peeled off as illustrated in FIG. 4 and the head engaging flange 3 with the tape attached is applied around the patient's head adjacent the hair line and pressed into sealing engagement, the flap 20 being folded over onto the flap 22 in a fluid-tight manner. When the tape is in place it presses against the patient's skin to form a fluid barrier between the hood 1 and skin preventing water and shampoo from passing onto the face. The plunger 54 of the pump 53 is then worked up and down a number of times to pressurizes the supply tank 52. The nozzle 50 or 60 is then operated to deliver a spray of warm water from the supply tank 52, 70 through the inlet 6 at the top of the hood 2. With the hair wet, shampoo is applied through the inlet opening 6 and the user inserts his hands through the opening 6 to shampoo the hair and massage the scalp. In addition, by manipulating the outer surface of the upper portion of the hood 2 the attendant can further massage the hair and scalp. The spray nozzle 50 or 60, is operated again to rinse the hair as required. Run-off of water and shampoo suds are collected in the pocket 30.

When the hair is washed, the hood 2 is readily removed by peeling the tapes 10 and 20 away from the user's skin, the pocket 30 is emptied and the hood 2 is disposed of.

It will be appreciated that in some cases a drain may be fitted at a lower end of the hood pocket 30 in order to allow either a continuous or, by fitting a valve, controlled discharge of water from the pocket 30.

The invention is not limited to the embodiments hereinbefore described which may be varied in construction and detail.

What is claimed is:

1. A hair washing aid comprising:

a flexible hood of water impermeable plastic sheet material, the hood having:

a head engaging flange defining an opening in the hood for fitting around the head and enclosing hair within the hood;

sealing means including a pressure sensitive double sided adhesive tape, one side of the double-sided adhesive tape being attached to the inner surface of the head engaging flange and another side of the double-sided adhesive tape being covered with a liner, the liner being peelable to expose the adhesive on said other side of the tape for sealing engagement to the head to form a fluid barrier; and an entry flange defining an inlet opening adjacent a top of the hood for receiving water and shampoo, the inlet being sized to accommodate an attendant's hands for washing the hair enclosed by the hood.

2. A hair washing aid as recited in claim 1 wherein the tape and adhesive are of hypo-allergenic material.

3. A hair washing aid as recited in claim 1 wherein the hood includes an overlapping flap portion adjacent the head engaging flange to accommodate a range of head sizes.

4. A hair washing aid as recited in claim 3 wherein the overlapping flap portion has a free end with a double sided tape for sealing to the top of the hood.

5. a hair washing aid as recited in claim 1 wherein the hood includes a portion extending from the top defining a collecting pocket for receiving water run-off from the hair enclosed by the hood.

6. A hair washing aid as recited in claim 5 further comprising a liquid drain tube attached to the pocket for draining liquid from the pocket.

7. A hair washing aid as recited in claim 1 wherein the hood is formed from two sheets of flexible plastic material joined together along edges thereof between the head engaging flange and the entry flange.

8. A hair washing aid as recited in claim 7 wherein the hood is formed from two sheets of flexible plastic material joined together along edges thereof between the head engaging flange and the entry flange.

9. A hair washing aid as recited in claim 1 further comprising a spray nozzle for delivering a fine spray of water through the inlet opening in the hood.

10. A hair washing aid as recited in claim 9 further comprising a liquid supply container and a pump for delivery of liquid from the container to the nozzle.

11. A hair washing aid as recited in claim 1 wherein the defined inlet opening has a substantially smaller diameter than the defined head fitting opening.

* * * * *